United States Patent [19]

Perrigo et al.

[11] 4,022,541

[45] May 10, 1977

[54] ASSEMBLED DIFFUSER

[75] Inventors: Wallace Perrigo, Speedway; Esten W. Spears, Jr., Indianapolis, both of Ind.

[73] Assignee: General Motors Corporation, Detroit, Mich.

[22] Filed: Apr. 12, 1976

[21] Appl. No.: 676,153

[52] U.S. Cl. ..... 415/207; 415/211

[51] Int. Cl.[2] ..... F04D 29/54

[58] Field of Search ..... 415/207, 211

[56] References Cited

UNITED STATES PATENTS

| | | | |
|---|---|---|---|
| 2,708,883 | 5/1955 | Keller et al. | 415/207 |
| 2,967,013 | 1/1961 | Dullenbach et al. | 415/211 |
| 3,150,823 | 9/1964 | Adams | 415/211 |
| 3,289,922 | 12/1966 | Sawyer | 415/208 |
| 3,706,510 | 12/1972 | O'Connor | 415/207 |
| 3,743,436 | 7/1973 | O'Conner | 415/211 |
| 3,873,232 | 3/1975 | Stein et al. | 415/207 |
| 3,930,746 | 1/1976 | Kronogarol | 415/211 |
| 3,941,501 | 3/1976 | Shank | 415/211 |

*Primary Examiner*—Henry F. Raduazo
*Attorney, Agent, or Firm*—J. C. Evans

[57] ABSTRACT

A diffuser for association with a centrifugal compressor includes a circumferentially disposed array of like, individual diffuser vanes each having integrally formed opposed flange pairs thereon joined by a bridge segment having a continually increasing depth from an inlet end of each of the vanes to the outlet end thereof. Adjacent ones of the vanes have their flange pairs juxtaposed to form a three-dimensional air flow passage between each of the vanes and wherein each vane has a spiral formed inlet wall pair extending radially inwardly at the inlet of each vane to form a spiral configured open inlet path into each of the three dimensional flow passages; the individual vanes being held in the circumferentially disposed array by spaced apart side support plates and fastening means directed through each of the side support plates and the bridge segments of each of the vanes.

4 Claims, 6 Drawing Figures

ASSEMBLED DIFFUSER

The present invention relates to diffuser assemblies and more particularly to compressor diffuser assemblies for association with centrifugal compressors having an axial inlet and radial outlet and wherein the diffuser assembly includes three dimensional passages therein for converting high velocity gas flow from the radial outlet of the compressor to pressure energy by flow of fluid through the diffuser passages. Centrifugal compressors having a bladed rotor or impeller are operative to direct compressed air in a tangential and radial direction while imparting a high velocity to the induced air flow therethrough. Various proposals have been suggested for diffusing outlet air which flows radially and circumferentially of the axis of rotation of a centrifugal compressor impeller to the kinetic energy of the air flow from the impeller to pressure energy.

On such proposal disclosed in U.S. Pat. No. 3,778,186 issued Dec. 11, 1973, to Bandukwalla has grooves in each of a pair of side wall portions of a diffuser to have a three dimensional trough therein with a cross section that changes in dimension from a semicircular groove to a semielliptical groove from the inlet to the outlet end of the diffuser side walls. The side walls are joined along a part line located in a radially outwardly directed plane between the first and second side walls of the diffuser. The resultant diffuser flow path to the diffuser assembly is a three dimensional passage of variable area which is suitable for converting kinetic energy to pressure energy in the air flow directed from a centrifugal impeller to the diffuser.

Such arrangements, however, require the formation of side plate grooves having a cross section of variable shape with continuously curvilinear walls. Furthermore, the part line must be carefully aligned to define the resultant circular to elliptical flow passages.

An object of the present invention is to simplify the manufacture and assembly of compressor diffuser assemblies of the type including three dimensional flow passages therethrough for converting the kinetic energy of air flow from a centrifugal compressor to pressure energy and to do so by means of an array of circumferentially located like individual vanes each including a solid wedge shaped bridge having a tapered inlet and a radially outwardly located outlet end portion of substantial arcuate extent along the outlet of the vane and wherein each vane further includes a pair of radially outwardly directed side flange portions formed integrally with the bridge with the flanges having variable height and thickness from the tapered inlet to the outlet end of the vane; the vane further including a pair of radially inwardly directed flange portions of variable height and thickness from the tapered inlet to the outlet end of the vane; and wherein the like individual vanes are located in the circumferentially arranged array so that radially inwardly and outwardly located flanges on adjacent vanes form plural passages with flat side walls and an increasing cross section of three dimensional form from the inlet to the outlet of the diffuser.

Yet another object of the present invention is to simplify the manufacture of a diffuser for a centrifugal compressor by the provision of a plurality of like vanes which can be stacked circumferentially around the outer periphery of a centrifugal compressor impeller and wherein each of the vanes includes channel cross sectioned grooves in opposed surfaces therin; each groove of a height which increases from the inlet to the outlet of the vane and formed with spaced apart flange portions that are juxtaposed at an interface between each of the vanes to form a three dimensional passage through the diffuser assembly and wherein each of the separate vanes in the plurality are joined by side reinforcement plates to form a complete diffuser assembly.

Still another objecct of the present invention is to provide an improved vane element for use in a multiunit diffuser for defining a passage with three dimensional increases in volume for converting kinetic energy of air flow radially and circumferentially from a centrifugal impeller to pressure energy and wherein each vane element includes a wedge shaped bridge with an inlet tip and an outlet segment and further including a pair of oppositely directed integrally formed flanges of varying height to define a channel on either side of the vane element including a curved side wall portion for defining a spiral flow path to the inlet tip and wherein the vanes are locatable in juxtaposed relationship to locate the opposed flanges on each of the vanes together to form a three dimensional flow passage of increasing cross section from the inlet of each bridge segment to the outlet of the diffuser assembly.

Further objects and advantages of the present invention will be apparent from the following description, reference being had to the accompanying drawings wherein a preferred embodiment of the present invention is clearly shown.

Figure 1:
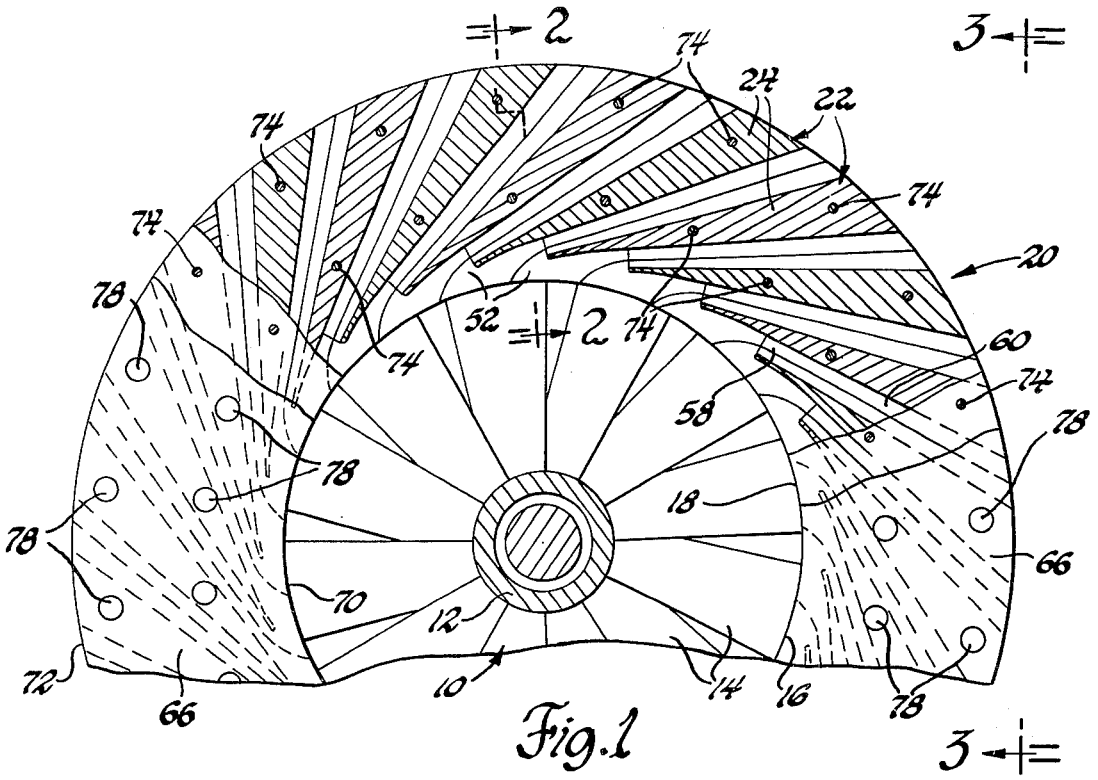
FIG. 1 is a fragmentary front elevational view, partially broken away and sectioned, of a diffuser assembly in accordance with the present invention.

Centrifugal compressors of the type having an axial inlet and a radial outlet are well known and for purposes of the present invention an impeller 10 is shown in FIG. 1 in a front elevational view. It includes a hub 12 having a plurality of radially outwardly directed blades 14 thereon each having a peripheral tip 16 located closely proximate to an inner peripheral wall 18 of a diffuser assembly 20 constructed in accordance with the present invention.

The impeller 10 is driven clockwise as illustrated in FIG. 1. It discharges air with a substantial radial component, and also a greater circumferential component of velocity from the perimeter of the impeller 10 into the stationary diffuser assembly 20.

Figure 4:
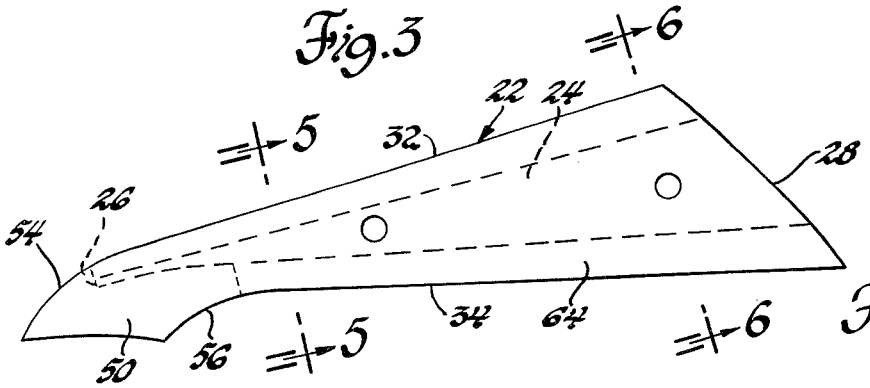
FIG. 4 is a side elevational view of a vane component of the diffuser assembly in FIG. 1.

In accordance with the present invention the diffuser assembly 20 is characterized as being operative to convert the kinetic energy of air delivered from the impeller 10 to potential energy of pressure. To accomplish this objective, the diffuser assembly 20 includes a plurality of separate diffuser vanes 22 one of which is illustrated in FIG. 4. Each of the vanes 22 includes a wege configured bridge 24 having a thin sectioned nose portion or inlet tip 26 and further includes an outer peripheral, arcuate segment 28. Segments 28, together extend continuously circumferentially to define the outer periphery of the stationary diffuser assembly 20. Each vane 22 further includes integrally formed oppositely directed pairs of flanges 30, 32 and 34, 36. The flange pair 30, 32 on each of the vanes 22 faces toward the radial outward periphery of the diffuser assembly 20 and each of the flange pair 34, 36 are faced radially inwardly of the diffuser assembly 20.

The bridge 24 increases in depth from the tip 26 to the outlet segment 28 thereof and with flanges 30, 32 defines an open channel 38 on one side of the bridge 24 which increases in height from the tip 26 of the vane 22 to the outer peripheral segment 28 thereon. Likewise, the bridge 24 and flanges 34, 36 define a channel 40 along the opposite side of each of the vanes 22 which increase in height from the tip 26 to the outer peripheral segment 28 thereof. The flanges 30, 32 are joined to the bridge 24 so as to define curved fillet corners 42, 44 extending along the vane 22 at the intersection between the flanges 30, 32 and the bridge portion 24 so that the channel 38 is smooth walled without abrupt transitions therein to interfere with flow continuity. Likewise, the intersection of the flanges 34, 36 and the bridge 24 includes curved fillet corners 46, 48 so that the channel 40 will have like smooth flow configuration.

Each of the individual vanes 22 includes spaced apart wall segments 50, 52 that define an inlet transition to the vane tip 26.

Each side wall 50, 52 includes a radially outwardly facing curvilinear fore edge 54 thereon and a radially inwardly facing curvilinear aft edge 56 thereon which merge with the outer edges of the flanges 30, 32 and 34, 36 respectively.

Figure 2:
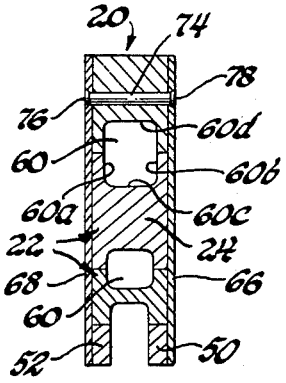
FIG. 2 is a fragmentary vertical sectional view taken along the line 2—2 of FIG. 1 looking in the direction of the arrows.
Figure 3:
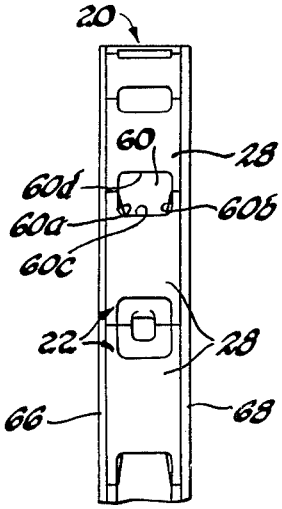
FIG. 3 is a side elevational view along the line 3—3 of FIG. 1 and lookin in the direction of the arrows.
Figure 5:
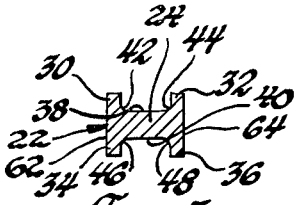
FIG. 5 is a cross sectional view taken along the line 5—5 of FIG. 4 looking in the direction of the arrows.
Figure 6:
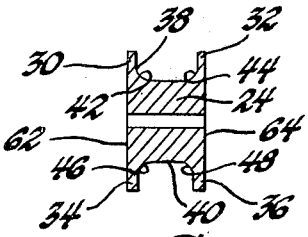
FIG. 6 is a cross sectional view taken along the line 6—6 of FIG. 4 looking in the direction of the arrows.

By virtue of the aforesaid described configuration of each of the vanes 22, the diffuser assembly 20 is easily assembled by locating the individual vanes 22 in a circumferentially arranged array around the outer periphery of the impeller 10 as shown in FIG. 1. When so placed, each of the vanes 22 has the outer edge portions of the flanges 30, 32 located in juxtaposed relationship with the outer edges of flanges 34, 36 on an adjacent vane 22. Likewise, the edges 54 are located in juxtaposed position with the edges 56. As a result, there is a smooth spiral inlet flow path from the outer periphery of the impeller 10 to a throat region 58 between one tip 26 of a first vane 22 and the bottom of the channel 40 on an adjacent element 22. The channels 38, 40 on adjacent vane elements combine to form a three dimensional flow passage 60 that extends from the throat region 58 to the outer periphery of the diffuser 20. In the illustrated embodiment, the thickness of side walls 50, 52 is extended so that the inlet width of passage 60 is reduced as shown in FIG. 2. Following the transition at throat 58 the thickness of flanges 30, 32, 34, 36 is reduced continuously along their lengths to produce a resultant increase in the width of passage 60 as it progresses in the downstream direction from throat 58. The control of flange thickness and height establishes a passage 60 of increasing multi-dimensional cross section as shown in FIG. 2 and has rounded edges at the corner intersection between each of the flanges 30, 32, 34 and 36 and the bridge 24. Passage 60 thus has flat side walls 60*a*, 60*b* of increasing height and a flat bottom surface 60*c* and a flat top surface 60*d* joined by rounded corners. By virtue of the present invention the diffuser 20 has a performance advantage over conventional vane diffusers which have sharp corners between the vane elements and side walls.

The diffuser 20, moreover, is easily assembled by arranging identical vanes 22 symmetrically in a circle such that a like number of diffuser passages 60 are formed. The longitudinal centerline of each passage 60 is shown straight and tangent to a circle having its center coincident with the center of the assembly 20. The passage centerline, however, need not be straight but can be curved as desired merely by changing flange height.

The identical vanes 22 can be fabricated by known processes including pressing and sintering of powdered metal or by known ceramic slip casting methods. The abutment of oppositely directed spaced flanges on the individual vanes 22 defines one complete diffuser flow passage 60 from the inner periphery to the outer periphery of the diffuser 20.

In the illustrated arrangement, each of the vanes 22 includes flat, wedge configured, opposite outer side surfaces 62, 64 that supportingly receive a pair of side support plates 66, 68 respectively. Each of the side support plates 66, 68 are ring members extending completely around the diffuser assembly 20. Each side plate 66, 68 includes an inner peripheral edge 70 thereon located radially outwardly of the outer periphery of the impeller 10. Each plate 66, 68 further includes an outer peripheral edge 72 that is flush with the outer peripheral segment 28 of each of the vanes 22 when they are assembled as shown in FIG. 1. The individual vanes 22 are fastened to the separate support plates 66, 68 by plurality of fastener elements representatively shown as being a rivet element 74 having head portions 76, 78 at opposite ends thereof headed into fastening engagement with the plates 66, 68 to secure the individual vanes 22 together as a completed diffuser.

While the embodiments of the present invention, as herein disclosed, constitute a preferred form, it is to be understood that other forms might be adopted.

The embodiments of the invention in which an exclusive property or privilege is claimed are defined as follows:

1. A diffuser for use in association with a centrifugal compressor comprising first and second axially spaced side plates, each of said first and second side plates having an inner peripheral edge and an outer periphery, a plurality of diffuser vanes arranged in a circumferential array, each of said vanes including wedge configured side surfaces, located in sealing engagement with said first and second side plates, means for securing said side plates to said vanes, said diffuser vanes each having an upper and a lower surface thereon diverging from each other from the inner to outer peripheries of said side plates, each of said vanes having a pair of upper side flanges, thereon integral with said side surfaces and extending longitudinally of said upper surface throughout its length, each of said vanes further including a pair of lower side flanges integral with said side surfaces and extending longitudinally of said lower surface, said upper and lower side flanges on adjacent vanes being juxtaposed to define a diffuser passage between adjacent one of said vanes having a closed perimeter defined by the upper and lower surface on adjacent vanes and juxtaposed upper and lower side flanges on each of the adjacent vanes and engaging each other and including an inlet and outlet, said paris of flanges each having a variable thickness to vary the cross sectional area of said passage from the inlet to the outlet of said passage, and means for securing said individual plates to said side walls to locate each of said separate vanes in a continuous circumferential array around the full circumference of said side plates.

2. A diffuser for use in association with a centrifugal compressor comprising first and second axially spaced side plates, each of said first and second side plates having an inner peripheral edge and an outer periphery, a plurality of diffuser vanes, each of said vanes including wedge configured side surfaces with an inner peripheral edge and an outer peripheral edge, said side surfaces being located in sealing engagement with said first and second side plates, said diffuser vanes each having an upper and a lower surface thereon diverging from each other from the inner to outer peripheries of said side plates, each of said vanes having a pair of upper side flanges, thereon integral with said side surfaces and extending longitudinally of said upper surface throughout its length, each of said vanes further including a pair of lower side flanges integral with said side surfaces and extending longitudinally of said lower surface, said upper and lower side flanges on adjacent vanes being juxtaposed to define a diffuser passage between adjacent one of said vanes having a closed perimeter defined by the upper and lower surface on adjacent vanes and juxtaposed upper and lower side flanges on each of the adjacent vanes and engaging each other and including an inlet and outlet, each of said vanes including a pair of spaced inlet walls each having a curved fore and aft edge following a spiral path from the inner peripheral edge of said side plates to merge with said upper and lower side flanges, said inlet walls on adjacent vanes being juxtaposed to form a spiral path from the inner peripheral edge of said side plates into the inlet of said diffuser passage for flow therethrough to the outer periphery of said side plates, and means for securing said individual plates to said side walls to locate each of said separate vanes in a continuous circumferential array around the full circumference of said side plates.

3. A diffuser for use in association with a centrifugal compressor comprising first and second axially spaced side plates, each of said first and second side plates having an inner peripheral edge and an outer periphery, a plurality of diffuser vanes, each of said vanes including wedge configured side surfaces, with an inner peripheral edge and an outer peripheral edge, said side surfaces being located in sealing engagement with said first and second side plates, said diffuser vanes each having an upper and a lower surface thereon diverging from each other from the inner to outer peripheries of said side plates, each of said vanes having a pair of upper side flanges, thereon integral with said side surfaces and extending longitudinally of said upper surface throughout its length, each of said vanes further including a pair of lower side flanges integral with said side surfaces and extending longitudinally of said lower surface, said upper and lower side flanges on adjacent vanes being juxtaposed to define a diffuser passage between adjacent ones of said vanes having a closed perimeter defined by the upper and lower surface on adjacent vanes and juxtaposed upper and lower side flanges on each of the adjacent vanes and engaging each other and including an inlet and an outlet, said pairs of flanges each having a variable thickness to vary the cross sectional area of said passage from the inlet to the outlet of said pasage, each of said vanes including a pair of spaced inlet walls each having a curved fore and aft edge following a spiral path from the inner peripheral edge of said side plates to merge with said upper and lower side flanges at the edge thereof, said inlet walls on adjacent vanes being juxtaposed to form a spiral path from the inner peripheral edge of said side plates into said diffuser passage for flow therethrough to the outer periphery of said side plates, and means for securing said individual plates to said side walls to locate each of said separate vanes in a continuous circumferential array around the full circumference of said side plates.

4. A diffuse for use in association with a centrifugal compressor comprising first and second axially spaced side plates, each of said first and second side plates having an inner peripheral edge and an outer periphery, a plurality of diffuser vanes, each of said vanes including wedge configured side surfaces with an inner peripheral edge and an outer peripheral edge, said side surfaces being located in sealing engagement with said first and second side plates said diffuser vanes each having an upper and a lower surface thereon diverging from each other from the inner to outer peripheries of said side plates, each of said vanes having a pair of upper side flanges, thereon integral with said side surfaces and extending longitudinally of said upper surface throughout its length, each of said vanes further including a pair of lower side flanges integral with said side surfaces and extending longitudinally of said lower surface, said upper and lower side flanges on adjacent vanes being juxtaposed to define a diffuser passage between adjacent ones of said vanes having a closed perimeter defined by the upper and lower surface on adjacent vanes and juxtaposed upper and lower side flanges on each of the adjacent vanes and engaging each other and including an inlet and outlet, said upper and lower surfaces being flat, said upper and lower side flanges having flat inboard surfaces, a fillet formed between the intersection of each of said flat inner surfaces of said flanges and said upper and lower surfaces to form rounded corners throughout the length of said passage, and means for securing said individual plates to said side walls to locate each of said separate vanes in a continuous circumferential array around the full circumference of said side plates.

* * * * *